US009576781B2

(12) United States Patent
Green et al.

(10) Patent No.: US 9,576,781 B2
(45) Date of Patent: Feb. 21, 2017

(54) INTELLIGENT DYNAMIC RANGE ENHANCEMENT

(71) Applicant: Micromass UK Limited, Wilmslow (GB)

(72) Inventors: Martin Raymond Green, Bowdon (GB); Steven Derek Pringle, Hoddlesden (GB); Jason Lee Wildgoose, Stockport (GB)

(73) Assignee: Micromass UK Limited, Wilmslow (GB)

( * ) Notice: Subject to any disclaimer, the term of this patent is extended or adjusted under 35 U.S.C. 154(b) by 0 days.

(21) Appl. No.: 14/902,897

(22) PCT Filed: Jul. 9, 2014

(86) PCT No.: PCT/GB2014/052093

§ 371 (c)(1),
(2) Date: Jan. 5, 2016

(87) PCT Pub. No.: WO2015/004457

PCT Pub. Date: Jan. 15, 2015

(65) Prior Publication Data

US 2016/0133450 A1 May 12, 2016

(30) Foreign Application Priority Data

Jul. 9, 2013 (EP) ..... 13175695
Jul. 9, 2013 (GB) ..... 1312265.0

(51) Int. Cl.
*H01J 49/06* (2006.01)
*H01J 49/00* (2006.01)
(Continued)

(52) U.S. Cl.
CPC ..... *H01J 49/061* (2013.01); *H01J 49/0031* (2013.01); *H01J 49/0036* (2013.01);
(Continued)

(58) Field of Classification Search
USPC ..... 250/281, 282
See application file for complete search history.

(56) References Cited

U.S. PATENT DOCUMENTS 6,878,929 B2 4/2005 Green et al.
6,894,275 B2 5/2005 Green et al.
(Continued)

*Primary Examiner* — Kiet T Nguyen
(74) *Attorney, Agent, or Firm* — Diederiks & Whitelaw, PLC

(57) ABSTRACT

A method of mass spectrometry is disclosed comprising transmitting ions and obtaining first mass spectral data and automatically determining during an acquisition whether the first mass spectral data suffers from saturation or is approaching saturation. If a determination is made during an acquisition that the first mass spectral data suffers from saturation or is approaching saturation then the method further comprises automatically changing or altering the intensity of ions which are detected by an ion detector and obtaining second mass spectral data. The method further comprises substituting one or more portions of the first mass spectral data with one or more corresponding portions of the second mass spectral data multiplied or scaled by an attenuation or scale factor and/or by an integer or other value so as to form a composite mass spectrum, wherein the composite mass spectrum comprises one or more ion peaks from the first mass spectral data and one or more ion peaks from the second mass spectral data.

17 Claims, 3 Drawing Sheets

(51) Int. Cl.
*H01J 49/02* (2006.01)
*H01J 49/10* (2006.01)
*H01J 49/40* (2006.01)

(52) U.S. Cl.
CPC ..... *H01J 49/025* (2013.01); *H01J 49/10* (2013.01); *H01J 49/40* (2013.01)

(56) References Cited

U.S. PATENT DOCUMENTS

| | | | | |
|---|---|---|---|---|
| 7,038,197 | B2 | 5/2006 | Bateman et al. | |
| 7,238,936 | B2 | 7/2007 | Okamura et al. | |
| 7,683,314 | B2 | 3/2010 | Green et al. | |
| 8,912,485 | B2 | 12/2014 | Maier et al. | |
| 9,129,781 | B2 | 9/2015 | Richardson | |
| 2010/0213361 | A1* | 8/2010 | Green | H01J 49/40 250/252.1 |
| 2011/0226943 | A1* | 9/2011 | Rather | H01J 49/0036 250/282 |
| 2011/0272573 | A1* | 11/2011 | Kostrzewa | H01J 49/0027 250/282 |
| 2013/0181123 | A1 | 7/2013 | Rather | |
| 2013/0338935 | A1 | 12/2013 | Watanabe et al. | |

* cited by examiner

INTELLIGENT DYNAMIC RANGE ENHANCEMENT

CROSS-REFERENCE TO RELATED APPLICATION

This application is the National Stage of International Application No. PCT/GB2014/052093, filed 9 Jul. 2014 which claims priority from and the benefit of United Kingdom patent application No. 1312265.0 filed on 9 Jul. 2013 and European patent application No. 13175695.9 filed on 9 Jul. 2013. The entire contents of these applications are incorporated herein by reference.

BACKGROUND OF THE PRESENT INVENTION

The present invention relates to a method of mass spectrometry and a mass spectrometer. The preferred embodiment relates to a system for and method of acquiring mass spectral data and relates to extending the dynamic range of a mass spectrometer.

There are two main types of digitiser detection systems which are used in conjunction with Time of Flight mass spectrometers namely Analogue to Digital ("ADC") and Time to Digital ("TDC") detector systems.

In a TDC based detector system only the arrival time of an ion is recorded. Multiple ion arrivals at substantially the same time are not recorded. In a TDC based system there is a dead-time associated with the analogue peak width of arriving ions which limits the ion flux of a species that may be counted/corrected for without leading to errors in both intensity and temporal measurement.

In an ADC based detector system the analogue signal from an ion detector is digitised and signals arising from multiple ion arrivals are recorded. However, the digitiser has a limited number of bits available. For example, an 8 bit ADC has a minimum value of 0 and a maximum value of 255 that corresponds to a given full scale deflection ("FSD") of e.g. 1V. If a signal exceeds the maximum FSD then only a value of 255 is recorded.

It is known that at high ion arrival rates the intensity of the input analogue signal from an ion detector of an orthogonal acceleration Time of Flight mass analyser may exceed the dynamic range of a digitising ADC. This saturation may lead to errors in both the final intensity and temporal measurement of the summed data (spectrum).

U.S. Pat. No. 7,038,197 (Micromass) discloses a method of increasing the dynamic range of a Time of Flight mass spectrometer by acquiring consecutive mass spectra wherein the ion intensity is attenuated in a first mass spectrum and is unattenuated in a second mass spectrum. Peaks or regions which have exceeded the dynamic range of the detection system in the second (unattenuated) mass spectrum are then replaced with corresponding data from the first (attenuated) mass spectrum. However, this known approach suffers from the problem that the duty cycle is permanently reduced.

GB-2483322 (Maier) discloses a method of acquiring multiple groups of mass spectra with a MALDI Time of Flight mass spectrometer, wherein the energy density of the laser spot is increased in discrete steps from group to group. A mass spectrum is obtained by replacing parts of a group mass spectrum which are subject to saturation by intensity extrapolations from mass spectra of groups acquired with lower energy densities in the laser spot.

US 2002/0063205 (Micromass) discloses providing a lens which is operated in a relatively high sensitivity mode. A control system switches the lens to operate in a relatively low sensitivity mode if a predefined mass peak in a mass spectrum is determined to be saturated or approaching saturation.

EP-1901332 (Micromass) discloses an ion beam attenuator wherein the degree of attenuation can be varied by varying a mark space ratio of the ion beam attenuator. The degree of attenuation of the ion beam attenuator may be increased when it is determined that one or more mass peaks in a mass spectrum are suffering from saturation or approaching saturation.

It is desired to provide an improved mass spectrometer and method of mass spectrometry.

SUMMARY OF THE PRESENT INVENTION

According to an aspect of the present invention there is provided a method of mass spectrometry comprising:

transmitting ions and obtaining first mass spectral data; and automatically determining during an acquisition whether the first mass spectral data suffers from saturation or is approaching saturation;

wherein if it is determined during an acquisition that the first mass spectral data suffers from saturation or is approaching saturation then the method further comprises:

(i) automatically changing or altering the intensity of ions which are detected by an ion detector and obtaining second mass spectral data; and (ii) substituting one or more portions of the first mass spectral data with one or more corresponding portions of the second mass spectral data multiplied or scaled by an attenuation or scale factor and/or by an integer or other value so as to form a composite mass spectrum, wherein the composite mass spectrum comprises one or more ion peaks from the first mass spectral data and one or more ion peaks from the second mass spectral data.

U.S. Pat. No. 7,038,197 (Micromass) does not disclose automatically determining during an acquisition whether mass spectral data which is being acquired suffers from saturation or is approaching saturation and on that basis changing (e.g. reducing) the intensity of ions during the course of the acquisition. Instead, the approach disclosed in U.S. Pat. No. 7,038,197 (Micromass) is to repeatedly switch between two transmission modes irrespective of whether or not one of the data sets suffers from saturation.

Similarly, GB-2483322 (Maier) does not disclose automatically determining during an acquisition whether mass spectral data which is being acquired suffers from saturation or is approaching saturation and on that basis changing (e.g. reducing) the intensity of ions during the course of the acquisition. Instead, the approach disclosed in GB-2483322 (Maier) is to obtain multiple mass spectra data sets irrespective of whether or not the data sets suffer from saturation.

Although US 2002/0063205 (Micromass) and EP-1901332 (Micromass) do disclose arrangements which automatically attenuate an ion beam upon determining that mass spectral data is suffering from saturation, US 2002/0063205 (Micromass) and EP-1901332 (Micromass) do not disclose the step of substituting one or more portions of first mass spectral data with one or more corresponding portions of second mass spectral data (which is preferably obtained at a relatively lower sensitivity and hence is unlikely to be suffering from saturation) so as to form a composite mass spectrum, wherein the composite mass spectrum comprises one or more ion peaks from the first mass spectral data and one or more ion peaks from the second mass spectral data.

This important distinction between the present invention and the approach disclosed in US 2002/0063205 (Micromass) and EP-1901332 (Micromass) will be discussed in more detail with reference to FIGS. 1A and 1B.

FIG. 1A shows two ion peaks in a mass spectrum. The first ion peak corresponds with e.g. 1000 ions and the second ion peak corresponds with e.g. 10 ions. It may be assumed that the ion detector suffers from saturation if an ion peak comprises ≥1000 ions.

Following the approach disclosed in US 2002/0063205 (Micromass) and EP-1901332 (Micromass) since the first ion peak is at saturation then the detection system may increase the attenuation factor of an ion beam attenuator. For example, assuming that the detection system increases the attenuation factor by ×10 then the first ion peak will be reduced to 100 ions and the second ion peak will be reduced to a single ion (which is undetectable) as shown in FIG. 1B.

The known approach allows the overall dynamic range of the ion detection system to be extended but the in-spectrum dynamic range is compromised since low intensity peaks are effectively lost.

In contrast, following the approach of the present invention the resulting (composite) mass spectrum would comprise the first ion peak as shown in FIG. 1B scaled by the attenuation factor and the unattenuated second ion peak as shown in FIG. 1A. Accordingly, the resulting mass spectrum obtained according to the present invention will have a significantly improved in-spectrum dynamic range.

The present invention is also advantageous in that by only switching to obtain a lower intensity mass spectral data set when actually required the duty cycle is thereby improved.

The step of changing or altering the intensity of ions which are detected by the ion detector preferably comprises reducing the intensity of ions which are detected by the ion detector.

The method preferably further comprises providing an ion transmission control device.

The step of changing or altering the intensity of ions which are detected by the ion detector preferably comprises changing or altering an ion transmission efficiency of the ion transmission control device.

The ion transmission control device preferably comprises an ion gate.

The step of changing or altering the intensity of ions which are detected by the ion detector preferably comprises changing or altering an ion transmission efficiency of the ion gate by preferably varying a mark-space ratio of the ion gate or by otherwise varying a ratio of the period of time ($T_{on}$) that the ion gate is arranged to transmit ions to the period of time ($T_{off}$) that the ion gate is arranged to attenuate ions.

The ion transmission control device preferably comprises an ion lens.

The step of changing or altering the intensity of ions which are detected by the ion detector preferably comprises changing or altering a focusing characteristic of the ion lens.

The method preferably further comprises passing ions through the ion transmission control device and variably controlling the intensity of ions which are onwardly transmitted by the ion transmission control device.

The method preferably further comprises providing an ion source.

The step of changing or altering the intensity of ions which are detected by the ion detector may comprise changing or altering an ionisation efficiency of the ion source.

The step of automatically determining during an acquisition whether the first mass spectral data suffers from saturation or is approaching saturation comprises determining whether the first mass spectral data includes intensity values ≥80% of a maximum intensity value, wherein the maximum intensity value is indicative of saturation or that a dynamic range of an ion detector has been exceeded.

The maximum intensity value preferably corresponds to the maximum intensity value output from or a full scale deflection of an Analogue to Digital Converter ("ADC").

The method preferably further comprises multiplying or scaling the second mass spectral data by an attenuation or scale factor and/or by an integer or other value.

According to the preferred embodiment if it is determined that the first mass spectral data does not suffer from saturation or is not approaching saturation then the method further comprises obtaining third mass spectral data without automatically changing or altering the intensity of ions which are detected by the ion detector.

The method preferably further comprises summing or combining the first and third mass spectral data.

According to another aspect of the present invention there is provided a mass spectrometer comprising:

a control system analysed and adapted:

(i) to transmit ions and obtain first mass spectral data; and (ii) to determine during an acquisition whether the first mass spectral data suffers from saturation or is approaching saturation, wherein if it is determined during an acquisition that the first mass spectral data suffers from saturation or is approaching saturation then the control system is further arranged and adapted:

(a) to change or alter the intensity of ions which are detected by an ion detector and to obtain second mass spectral data; and (b) to substitute one or more portions of the first mass spectral data with one or more corresponding portions of the second mass spectral data multiplied or scaled by an attenuation or scale factor and/or by an integer or other value so as to form a composite mass spectrum, wherein the composite mass spectrum comprises one or more ion peaks from the first mass spectral data and one or more ion peaks from the second mass spectral data.

The mass spectrometer preferably further comprises an ion transmission control device to control the intensity of ions which are detected by an ion detector.

According to an aspect of the present invention there is provided a method of mass spectrometry comprising:

transmitting ions and obtaining first mass spectral data; and automatically determining during an acquisition whether the first mass spectral data suffers from saturation or is approaching saturation;

wherein if it is determined during an acquisition that the first mass spectral data suffers from saturation or is approaching saturation then the method further comprises:

(i) automatically changing or altering the intensity of ions which are detected by an ion detector and obtaining second mass spectral data; and (ii) substituting one or more portions or the entirety of the first mass spectral data with one or more corresponding portions or the entirety of the second mass spectral data.

According to another aspect of the present invention there is provided a mass spectrometer comprising:

a control system analysed and adapted:

(i) to transmit ions and obtain first mass spectral data; and (ii) to determine during an acquisition whether the first mass spectral data suffers from saturation or is approaching saturation, wherein if it is determined during an acquisition that the first mass spectral data suffers from saturation or is approaching saturation then the control system is further arranged and adapted:

(a) to change or alter the intensity of ions which are detected by an ion detector and to obtain second mass spectral data; and (b) to substitute one or more portions or the entirety of the first mass spectral data with one or more corresponding portions or the entirety of the second mass spectral data.

According to an aspect of the present invention there is provided a method of mass spectrometry comprising:

acquiring a non-attenuated spectrum; and determining whether saturation has occurred;

wherein if saturation has occurred then said method further comprises:

acquiring an attenuated spectrum;

determining the peaks or regions where saturation has occurred in the non-attenuated spectrum; and substituting data from the attenuated data multiplied by an attenuation factor into the saturated or non-attenuated spectrum.

The spectrum is then preferably written to disk.

The present invention advantageously enables the duty cycle and sensitivity to be increased by only acquiring an attenuated spectrum when required.

A particular advantage of the present invention is that the duty cycle of the system is maintained in regions of the chromatogram where the intensity is low.

The present invention relates to a method of dynamic range enhancement that maintains duty cycle by interrogating the spectral data as it is acquired and preferably only interleaves attenuated scans when required or necessary.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxii) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions; and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example only, and with reference to the accompanying drawings in which.

DETAILED DESCRIPTION OF PREFERRED EMBODIMENTS

A known ion detection system is disclosed in US 2002/0063205 (Micromass) and EP-1901332 (Micromass) wherein the ion detection system automatically attenuates an ion beam upon determining that mass spectral data is suffering from saturation. The known approach as disclosed in US 2002/0063205 (Micromass) and EP-1901332 (Micromass) will be discussed in more detail below with reference to FIGS. 1A and 1B.

Figure 1A:
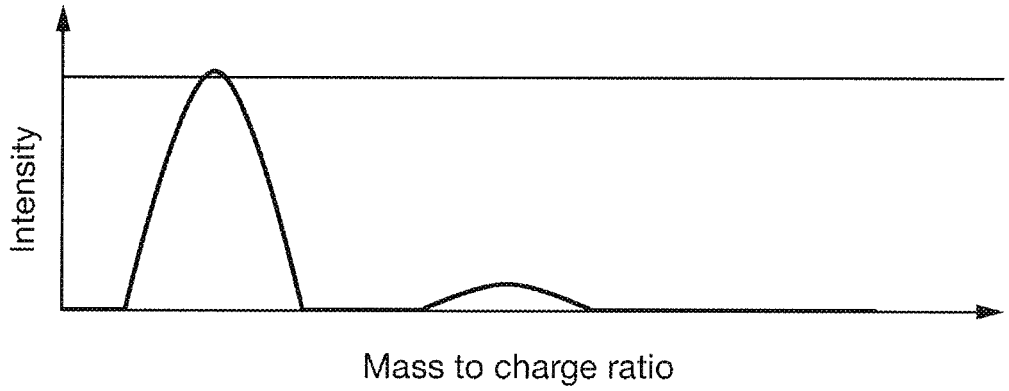
FIG. 1A illustrates a mass spectrum obtained at a first sensitivity and FIG. 1B illustrates a mass spectrum obtained at a second lower sensitivity.

FIG. 1A shows two ion peaks in a mass spectrum. The first ion peak corresponds with e.g. 1000 ions and the second ion peak corresponds with e.g. 10 ions. It may be assumed that the ion detector suffers from saturation if an ion peak comprises ≥1000 ions.

Figure 1B:
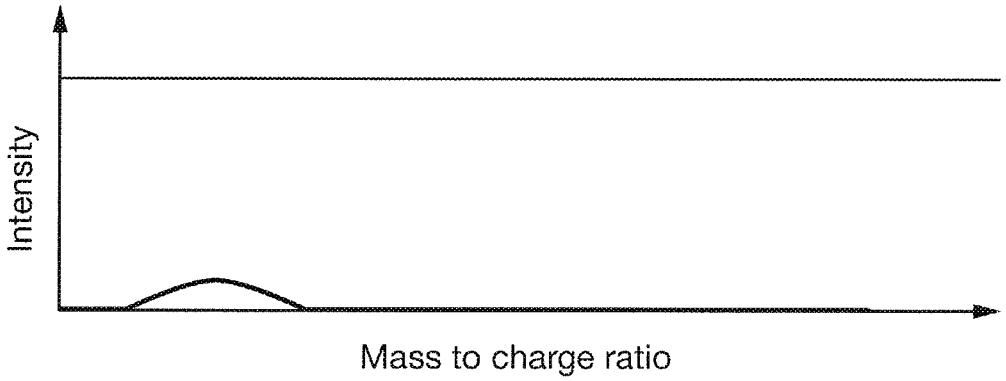

Following the approach disclosed in US 2002/0063205 (Micromass) and EP-1901332 (Micromass) since the first ion peak is at saturation then the known detection system may increase the attenuation factor of an ion beam attenuator. For example, assuming that the detection system increases the attenuation factor by ×10 then the first ion peak will be reduced to 100 ions and the second ion peak will be reduced to a single ion (which is undetectable) as shown in FIG. 1B.

The known approach allows the overall dynamic range of the ion detection system to be extended but the in-spectrum dynamic range is compromised since low intensity peaks are effectively lost.

Figure 2:
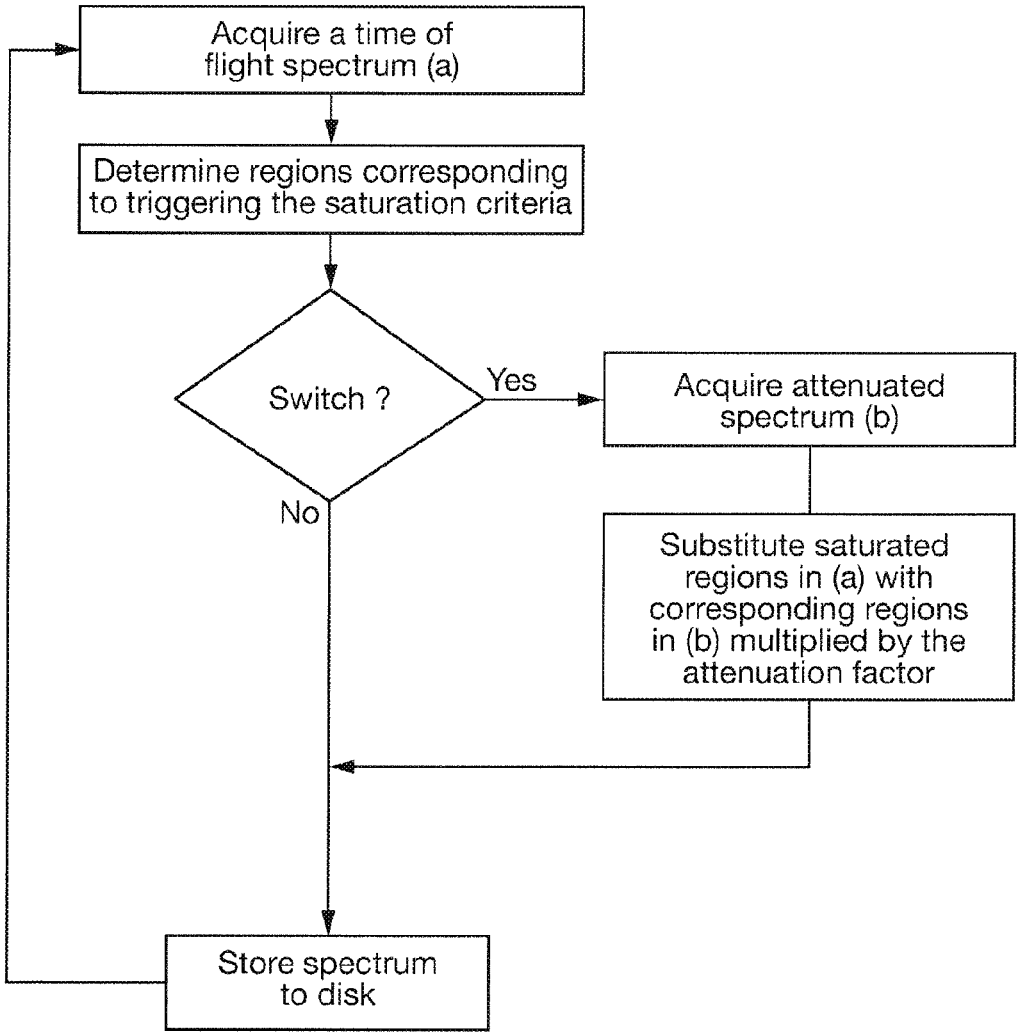
FIG. 2 shows a first embodiment of the present invention.

A first preferred embodiment of the present invention will now be described with reference to FIG. 2.

According to the first preferred embodiment a first time of flight spectrum, a first transient or first mass spectral data is preferably acquired. The first time of flight spectrum, first transient or first mass spectral data is then preferably analysed to determine whether or not there are any regions of the first time of flight spectrum, first transient or first mass spectral data which would suggest that the ion signal is sufficiently intense such that portions of the first time of flight spectrum, first transient or first mass spectral data are suffering from saturation. In particular, a determination is preferably made as to whether or not to switch or vary the transmission of the ion beam.

If a determination is made that no portions of the first time of flight spectrum, first transient or first mass spectral data is saturated or is approaching saturation then the ion transmission is preferably not varied and the first time of flight spectrum, first transient or first mass spectral data is preferably stored to disk or is otherwise combined with other time of flight spectra, transients or mass spectral data to form a combined or composite mass spectrum or mass spectral data set.

If a determination is made that one or more portions of the first time of flight spectrum, first transient or first mass spectral data is saturated or is approaching saturation then the ion transmission is preferably varied, preferably reduced, and a second time of flight spectrum, a second transient or second mass spectral data is preferably acquired. The second time of flight spectrum, second transient or second mass spectral data is preferably obtained at a reduced ion transmission.

Once a second time of flight spectrum, second transient or second mass spectral data has been obtained (at e.g. a reduced ion transmission) then the one or more portions of the first time of flight spectrum, first transient or first mass spectral data which were determined to suffer from saturation are preferably substituted with corresponding portions from the second time of flight spectrum, second transient or second mass spectral data.

The intensity values of the portions of the second time of flight spectrum, second transient or second mass spectral data which are preferably inserted into the first time of flight spectrum, first transient or first mass spectral data are preferably multiplied or otherwise scaled by an attenuation or other factor to compensate for the fact that the second time of flight spectrum, second transient or second mass spectral data was preferably obtained at a lower ion transmission than that of the first time of flight spectrum, first transient or first mass spectral data.

Figure 3:
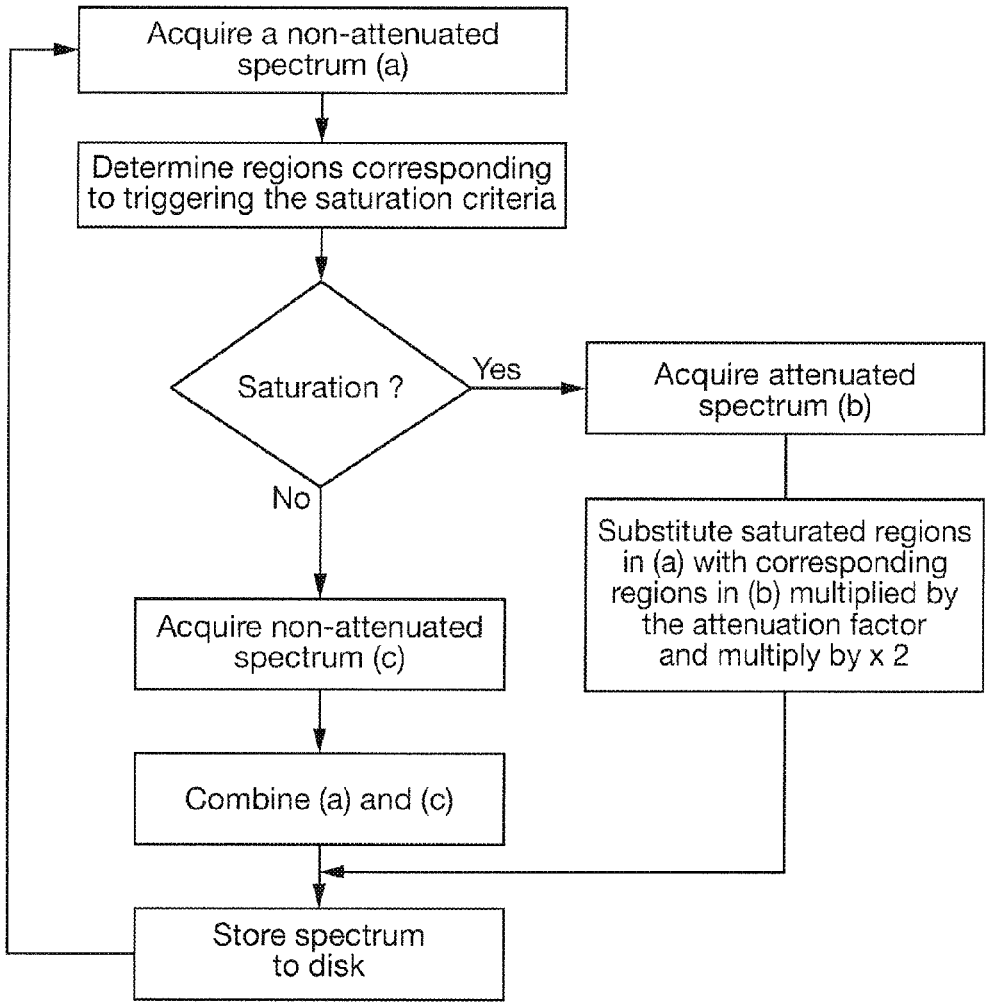
FIG. 3 shows a second embodiment of the present invention.

A second preferred embodiment will now be described with reference to FIG. 3.

According to a second preferred embodiment a first time of flight spectrum, a first transient or first mass spectral data is acquired. The first time of flight spectrum, first transient or first mass spectral data is then preferably analysed to determine whether or not there are any regions of the first time of flight spectrum, first transient or first mass spectral data which would suggest that the ion signal is sufficiently intense such that portions of the first time of flight spectrum, first transient or first mass spectral data are suffering from saturation. In particular, a determination is preferably made as to whether or not to switch or vary the transmission of the ion beam.

If a determination is made that no portions of the first time of flight spectrum, first transient or first mass spectral data are saturated or are approaching saturation then the ion transmission is preferably not varied and a further time of flight spectrum, a further transient or further mass spectral data is preferably acquired. The first and further time of flight spectra, the first and further transients or the mass spectral data and the further mass spectral data are then preferably summed or otherwise combined. The summed or combined time of flight spectra, transients or mass spectral data are then preferably stored to disk or are otherwise combined with other time of flight spectra, transients or mass spectral data to form a combined or composite mass spectrum or mass spectral data set.

If a determination is made that one or more portions of the first time of flight spectrum, first transient or first mass spectral data is saturated or is approaching saturation then the ion transmission is preferably varied, preferably reduced, and a second time of flight spectrum, second transient or second mass spectral data is preferably acquired. The second time of flight spectrum, second transient or second mass spectral data is preferably obtained at a reduced ion transmission.

Once a second time of flight spectrum, second transient or second mass spectral data has been obtained (at e.g. a reduced ion transmission) then the one or more portions of the first time of flight spectrum, first transient or first mass spectral data which were determined to suffer from saturation are preferably substituted with corresponding portions from the second time of flight spectrum, second transient or second mass spectral data.

The intensity values of the portions of the second time of flight spectrum, second transient or second mass spectral data which are preferably inserted into the first time of flight spectrum, first transient or first mass spectral data are preferably multiplied or otherwise scaled by an attenuation or other factor to compensate for the fact that the second time of flight spectrum, second transient or second mass spectral data was preferably obtained at a lower ion transmission than that of the first time of flight spectrum, first transient or first mass spectral data.

The intensity values of the regions of the second time of flight spectrum, second transient or second mass spectral data which are preferably inserted into the first time of flight spectrum, first transient or first mass spectral data are preferably also multiplied by a value of two or another integer since the corrected time of flight spectra, transients or mass spectral data effectively replaces the equivalent of two or more separate acquisitions which would otherwise have been acquired if the first time of flight spectrum, first transient or first mass spectral data was not determined to suffer from saturation.

The method according to the preferred embodiment may be applied to instruments other than Time of Flight mass analysers that use an ADC or similar counting system. For example, the present invention also extends to the use of quadrupole mass analysers, electrostatic ion trap mass analysers, RF ion trap mass analysers, ion mobility spectrometers ("IMS"), Field Asymmetric Ion Mobility Spectrometers ("FAIMS"), differential ion mobility separators ("DMS") or various combinations thereof.

According to an embodiment the detector system does not need to be actually saturated in order to switch to acquire mass spectral data at a different i.e. reduced ion transmission. For example, according to an embodiment if the system is approaching saturation wherein the detected intensity is approximately 70%, 75%, 80%, 85%, 90% or 95% of the maximum prior to causing saturation, then a determination may nonetheless be made to switch mode and acquire mass spectral data at e.g. a lower ion transmission.

The system may be set to include a proportion of saturated data points before triggering a Dynamic Range Enhancement ("DRE") mode of operation.

According to an embodiment the acquisition time for acquiring an attenuated spectrum may be arranged to be significantly shorter than the acquisition time for acquiring an unattenuated spectrum.

Once the system has determined that saturation has occurred or is about to occur, the acquisition time may be reduced or changed to maintain a desired number of sampled points across a chromatographic peak. This preferably continues until no saturation is detected or determined.

The decision as to whether to switch to acquire mass spectral data in an attenuated mode of operation wherein the ion transmission is preferably reduced may be made as data is being collected or acquired i.e. as a mass spectral histogram is being built up.

According to an embodiment the system may run at twice the required acquisition rate for a desired number of sampled points across a chromatographic peak by combining consecutive scans if switching does not occur. This is illustrated in the flow diagram shown in FIG. 3.

The spectra may be combined and normalised as a post processing procedure.

Although the present invention has been described with reference to preferred embodiments, it will be understood by those skilled in the art that various changes in form and detail may be made without departing from the scope of the invention as set forth in the accompanying claims.

The invention claimed is:

1. A method of mass spectrometry comprising:

transmitting ions and obtaining first mass spectral data; and automatically determining during an acquisition whether said first mass spectral data suffers from saturation or is approaching saturation;

wherein if it is determined during an acquisition that said first mass spectral data suffers from saturation or is approaching saturation then said method further comprises:

(i) automatically changing or altering the intensity of ions which are detected by an ion detector and obtaining second mass spectral data; and (ii) substituting one or more portions of said first mass spectral data with one or more corresponding portions of said second mass spectral data multiplied or scaled by an attenuation or scale factor or by an integer or other value so as to form a composite mass spectrum, wherein said composite mass spectrum comprises one or more ion peaks from said first mass spectral data and one or more ion peaks from said second mass spectral data.

2. A method as claimed in claim 1, wherein the step of changing or altering the intensity of ions which are detected by said ion detector comprises reducing the intensity of ions which are detected by said ion detector.

3. A method as claimed in claim 1, further comprising providing an ion transmission control device.

4. A method as claimed in claim 3, wherein the step of changing or altering the intensity of ions which are detected by said ion detector comprises changing or altering an ion transmission efficiency of said ion transmission control device.

5. A method as claimed in claim 3, wherein said ion transmission control device comprises an ion gate.

6. A method as claimed in claim 5, wherein the step of changing or altering the intensity of ions which are detected by said ion detector comprises changing or altering an ion transmission efficiency of said ion gate by varying a mark-space ratio of said ion gate or by otherwise varying a ratio of the period of time ($T_{on}$) that said ion gate is arranged to transmit ions to the period of time ($T_{off}$) that said ion gate is arranged to attenuate ions.

7. A method as claimed in claim 3, wherein said ion transmission control device comprises an ion lens.

8. A method as claimed in claim 7, wherein the step of changing or altering the intensity of ions which are detected by said ion detector comprises changing or altering a focusing characteristic of said ion lens.

9. A method as claimed in claim 3, further comprising passing ions through said ion transmission control device and variably controlling the intensity of ions which are onwardly transmitted by said ion transmission control device.

10. A method as claimed in claim 1, further comprising providing an ion source.

11. A method as claimed in claim 10, wherein the step of changing or altering the intensity of ions which are detected by said ion detector comprises changing or altering an ionisation efficiency of said ion source.

12. A method as claimed in claim 1, wherein the step of automatically determining during an acquisition whether said first mass spectral data suffers from saturation or is approaching saturation comprises determining whether said first mass spectral data includes intensity values ≥70%, 75%, 80%, 85%, 90% or 95% of a maximum intensity value, wherein said maximum intensity value is indicative of saturation or that a dynamic range of an ion detector has been exceeded.

13. A method as claimed in claim 12, wherein said maximum intensity value corresponds to the maximum intensity value output from or a full scale deflection of an Analogue to Digital Converter ("ADC").

14. A method as claimed in claim 1, wherein if it is determined that said first mass spectral data does not suffer from saturation or is not approaching saturation then said method further comprises obtaining third mass spectral data without automatically changing or altering the intensity of ions which are detected by said ion detector.

15. A method as claimed in claim 14, further comprising summing or combining said first and third mass spectral data.

16. A mass spectrometer comprising:

a control system arranged and adapted:

(i) to transmit ions and obtain first mass spectral data; and (ii) to determine during an acquisition whether said first mass spectral data suffers from saturation or is approaching saturation, wherein if it is determined during an acquisition that said first mass spectral data suffers from saturation or is approaching saturation then said control system is further arranged and adapted:

(a) to change or alter the intensity of ions which are detected by an ion detector and to obtain second mass spectral data; and (b) to substitute one or more portions of said first mass spectral data with one or more corresponding portions of said second mass spectral data multiplied or scaled by an attenuation or scale factor or by an integer or other value so as to form a composite mass spectrum, wherein said composite mass spectrum comprises one or more ion peaks from said first mass spectral data and one or more ion peaks from said second mass spectral data.

17. A mass spectrometer as claimed in claim 16, further comprising an ion transmission control device to control the intensity of ions which are detected by an ion detector.

* * * * *